US005122081A

United States Patent [19]

Bogiel et al.

[11] Patent Number: 5,122,081

[45] Date of Patent: Jun. 16, 1992

[54] ELECTRICAL POWER CONNECTOR

[75] Inventors: Steven B. Bogiel, Schaumburg; Mark M. Data, Bolingbrook; Robert DeRoss; David M. Skowronski, both of Naperville, all of Ill.

[73] Assignee: Molex Incorporated, Lisle, Ill.

[21] Appl. No.: 807,736

[22] Filed: Dec. 16, 1991

Related U.S. Application Data

[63] Continuation of Ser. No. 682,819, Apr. 9, 1991, abandoned.

[51] Int. Cl.[5] ..... H01R 13/40; H01R 13/44

[52] U.S. Cl. ..... 439/596; 439/595

[58] Field of Search ..... 439/595, 596, 603

[56] References Cited

U.S. PATENT DOCUMENTS

| | | | |
|---|---|---|---|
| 4,257,666 | 3/1981 | Schauer et al. | 439/596 |
| 4,660,914 | 4/1987 | Nakamura | 439/596 |
| 4,750,893 | 6/1988 | Sueyoshi et al. | 439/596 |
| 4,758,183 | 7/1988 | Aoyama | 439/596 |
| 4,767,361 | 8/1988 | Hoshino et al. | 439/596 |
| 4,867,705 | 9/1989 | Yuasa | 439/596 |
| 4,979,913 | 12/1990 | Aiello et al. | 439/596 |
| 5,076,806 | 12/1991 | Hotla et al. | 439/596 |

FOREIGN PATENT DOCUMENTS

| | | | |
|---|---|---|---|
| 4000436 | 7/1990 | Fed. Rep. of Germany | 439/596 |
| 2062979 | 5/1981 | United Kingdom | 439/596 |

*Primary Examiner*—Paula A. Bradley
*Attorney, Agent, or Firm*—Stephen Z. Weiss

[57] ABSTRACT

An electrical connector is provided with a dielectric housing having a forward mating end and a rear terminating end. The forward mating end has at least one terminal receiving cavity. A terminal is received in the cavity for connection to a complementary terminal of an appropriate mating connector when the mating connector is coupled to the mating end of the housing. The terminal is terminated to a conductor projecting from the rear terminating end of the housing. The rear end of the housing is provided substantially entirely by a pair of clam-shell members movably mounted on the forward end of the housing for movement between an open condition to allow the terminal easily to be inserted into the cavity and a closed condition securely encapsulating the inserted terminal. Complementary interengaging retaining portions are provided on the terminal and at least one of the clam-shell members for holding the terminal in the cavity when the clam-shell members are in their closed condition. Complementary interengaging latches are provided between the clam-shell members for latching the clam-shell members in their closed condition.

14 Claims, 2 Drawing Sheets

ELECTRICAL POWER CONNECTOR

This is a continuation of co-pending application Ser. No. 07/682,819 filed on Apr. 9, 1991, now abandoned.

FIELD OF THE INVENTION

This invention generally relates to the art of electrical connectors and, particularly, to a disconnectable electrical connector having one or more mateable terminals in a housing.

BACKGROUND OF THE INVENTION

Electrical power connectors, in contrast to more miniaturized electronic connectors, include a rather substantial blade contact mateable with a female contact terminal mounted in an insulative housing containing one or more of the mateable female terminals. Such connectors are used in a wide variety of applications or environments, such as in the appliance, automotive, computer and like industries wherein an apparatus is coupled to a main power source.

There seems to be a never ending desire to design power connectors of the character described which are both very cost-effective and extremely reliable, these two parameters often being conflicting in nature. In other words, without any limitation on costs, it is not too difficult to design a power connector which is very reliable and can withstand countless connections and disconnections. Conversely, rather inexpensive power connectors easily can be designed but which often have much to be desired as to their reliability. The costs of such connectors often revolve around manufacture and/or assembly considerations. For instance, reliable connectors can be designed with a multiplicity of rigidifying components but the manufacture of such multicomponent connectors is expensive.

This invention is directed to solving these dilemmas and to providing an electrical power connector which is extremely simple to manufacture, which facilitates easy assembly of the terminals into the housing of the connector, which employs a minimum of parts, and which provides a very reliable and secure connector construction.

SUMMARY OF THE INVENTION

An object, therefore, of the invention is to provide a new and improved, reliable and cost-effective electrical connector of the character described.

In the exemplary embodiment of the invention, the connector includes a dielectric housing having a forward mating end and a rear mating end. The forward mating end has at least one terminal receiving cavity. A terminal is received in the cavity for connection to a complementary terminal of an appropriate mating connector when coupled to the mating end of the housing. The terminal is terminated to a conductor projecting from the rear terminating end of the housing. The rear end of the housing is provided substantially entirely by a pair of clam-shell members movably mounted on the forward end of the housing for movement between an open condition to allow the terminal easily to be inserted into the cavity and a closed condition securely encapsulating the inserted terminal.

The invention contemplates the provision of complementary interengaging retaining means between the terminal and at least one of the clam-shell members for holding the terminal in the cavity when the clam-shell members are in the closed condition. In the preferred embodiment of the invention, the complementary interengaging retaining means are provided between the terminal and both clam-shell members. The retaining means include shoulders on opposite sides of the terminal engageable with a shoulder on each of the clam-shell members.

The invention also contemplates the provision of complementary interengaging latch means between the clam-shell members for latching the clam-shell members in the closed condition. In the preferred embodiment of the invention, the complementary interengaging latch means include a pair of interengaging latches between the clam-shell members, one pair of interengaging latches being at each opposite end of the housing. In addition, pairs of interengaging latches can be provided between the clam-shell members spanning the interior of the members when in their closed condition. As disclosed herein, the connector houses a plurality of terminals received in a plurality of cavities. The interengaging latches spanning the interior of the clam-shell members can be provided between the plurality of terminals.

In the preferred embodiment of the invention, the clam-shell members are movably mounted on the forward end of the housing by hinge means. Preferably, the entire housing is fabricated as a unitarily molded component, and the hinge means is provided by unitary living hinge portions of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
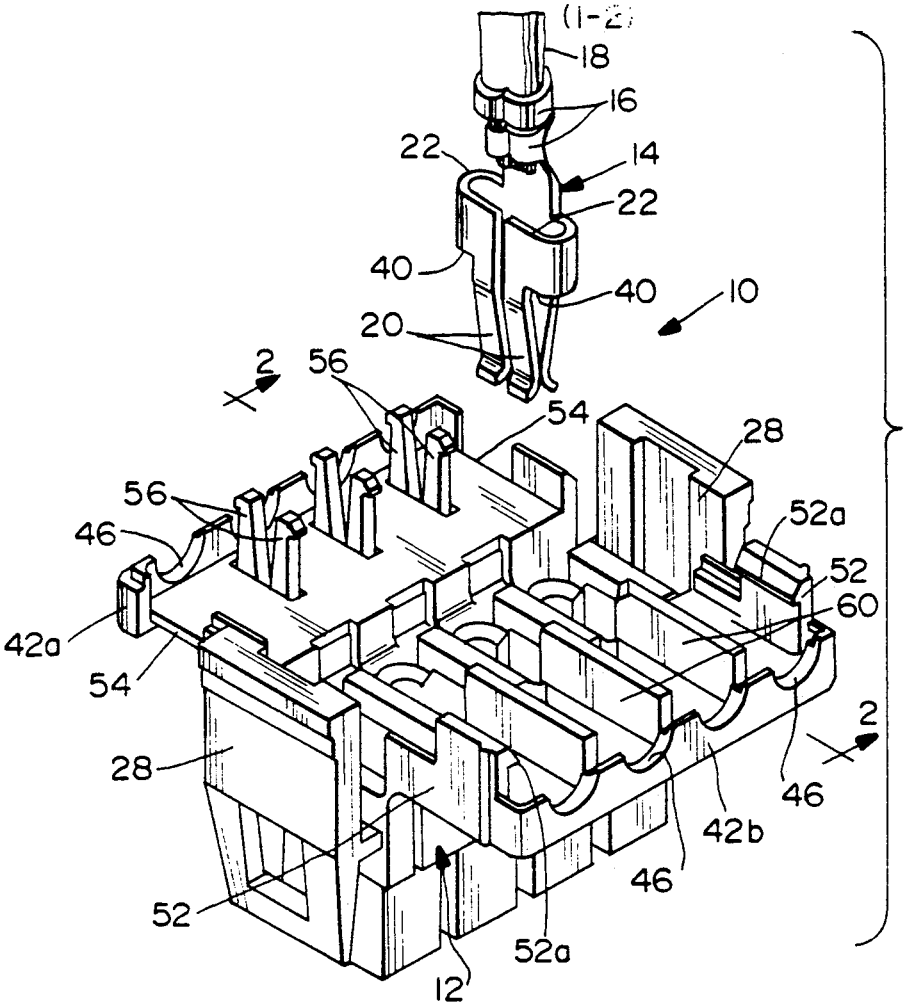
FIG. 1 is a perspective view of the electrical connector of the invention in its open or assembly condition.

Referring to the drawings in greater detail, and first to FIG. 1, an electrical power connector, generally designated 10, is illustrated in its fully open condition for assembly purposes. The connector includes a one-piece, unitarily molded housing, generally designated 12, and one or more terminals, generally designated 14 for free assembly into housing 12. The connector illustrated in the drawings is designed for receiving and housing four terminals 14, but it should be understood that the connector can accommodate any reasonable number of terminals. Only one terminal is shown in FIG. 1 in order to avoid cluttering the illustration.

Each terminal 14 is a one-piece component stamped and formed of sheet metal material, including a crimping portion 16 for terminating the terminal to the conductor or conductors of a power cable 18. Terminal 14 is formed as a female terminal and includes two pairs of opposing contact arms 20 providing jaws within which a contact blade-type terminal of an appropriate mating connector (not shown) is inserted when the mating connector is coupled to connector 10. Each terminal 14 also is formed with a pair of rearwardly facing (i.e., opposite the direction of insertion) shoulders 22 on opposite sides of the terminal.

Figure 2:
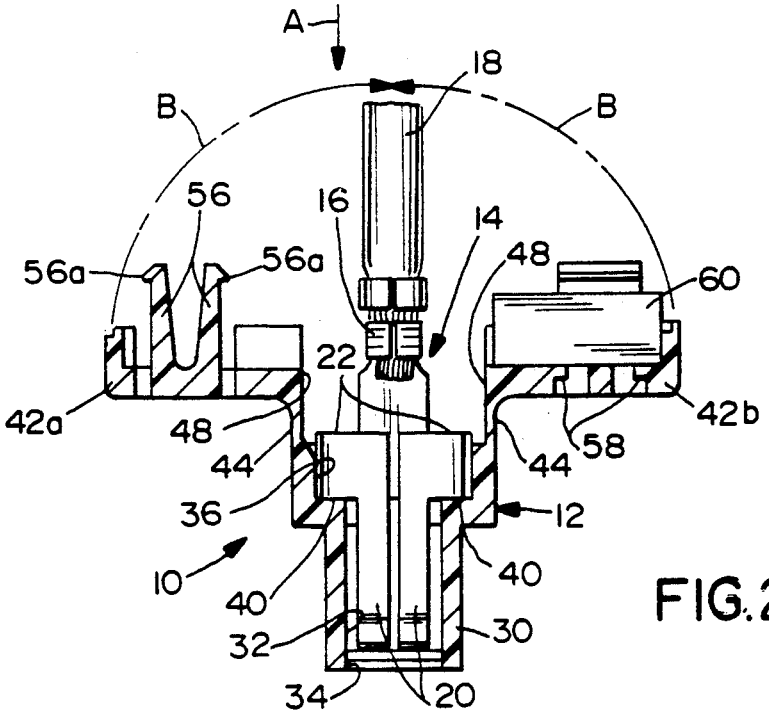
FIG. 2 is a vertical section taken generally along line 2—2 of FIG. 1.
Figure 3:
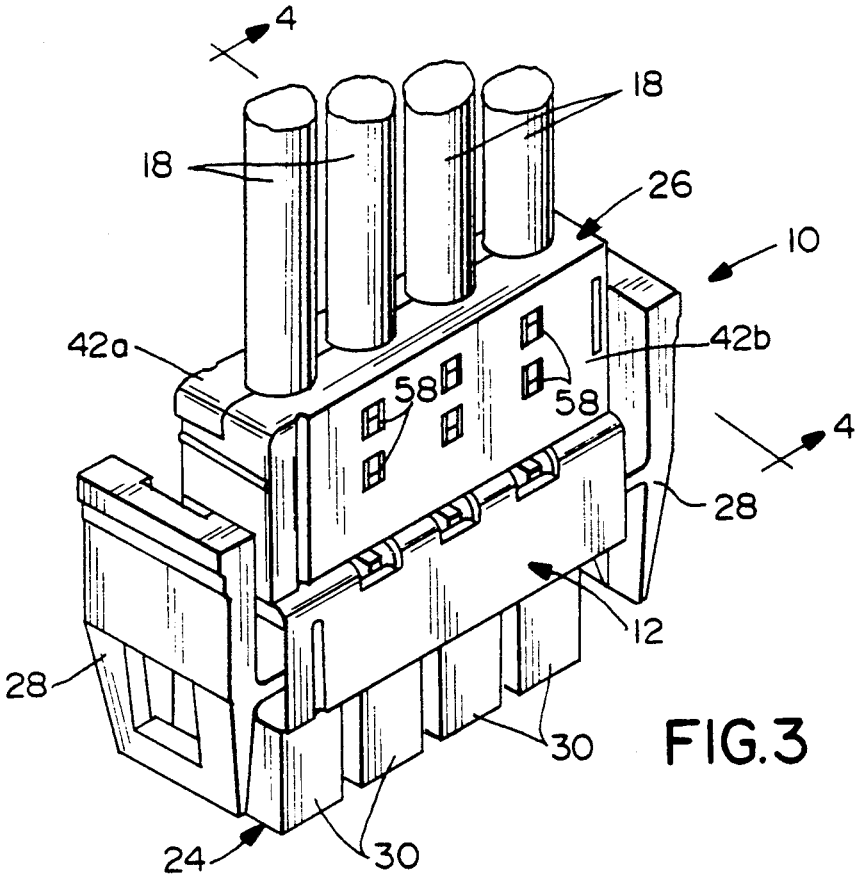
FIG. 3 is a perspective view of the electrical connector in its closed or assembled condition.
Figure 4:
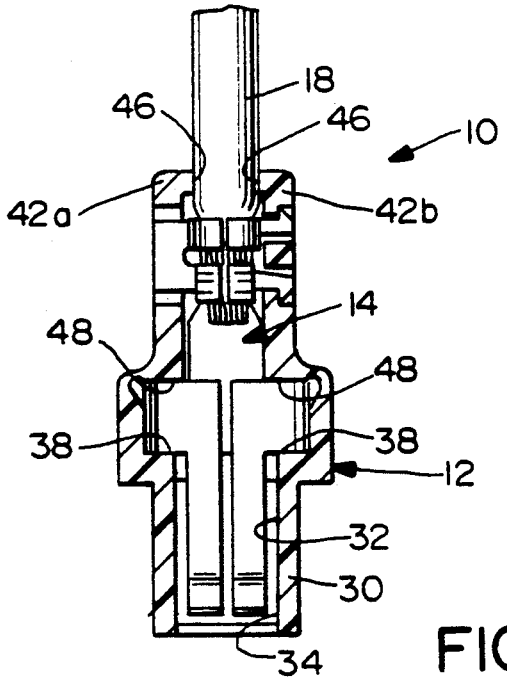
FIG. 4 is a vertical section taken generally along line 4—4 of FIG. 3.

Referring to FIG. 3 in conjunction with FIG. 1, unitarily molded housing 12 includes a forward mating end, generally designated 24, and a rear terminating end, generally designated 26. It can be seen that power cables 18 project outwardly of the rear terminating end. The housing also includes a pair of end locking arms 28 for releasably locking the connector to the appropriate mating connector (not shown). Referring to FIGS. 2 and 4 in conjunction with FIGS. 1 and 3, forward mating end 24 of housing 12 includes a plurality of silos 30 defining terminal receiving cavities 32. The cavities are open-ended, as at 34, for insertion thereinto of complementary blade terminals of the appropriate mating connector whereby the blade terminals can be inserted between the jaws defined by contact arms 20 of terminals 14. Each cavity 32 has a rear enlarged portion 36 defining shoulders 38 against which a pair of shoulders 40 (FIG. 1) of terminal 14 abut.

Rear terminating end 26 of housing 12 is defined substantially entirely by a pair of clam-shell members **42*a* and 42*b*. The clam-shell members are movably mounted on forward end 24 of housing 12 for movement between an open condition (FIGS. 1 and 2) to allow terminals 14 freely to be inserted into cavities 32, and a closed condition (FIGS. 3 and 4) to securely encapsulate the inserted terminals. In the preferred embodiment illustrated in the drawings, with housing 12 being unitarily molded of dielectric material, the clam-shell members are movably mounted on the forward end of the housing by living hinge portions 44 which are best seen in FIG. 2. FIG. 2 also best illustrates how clam-shell members 42*a* and 42*b*, when in their open condition, provide a totally unobstructed area or path for terminals 14 to be inserted into cavities 32**, as indicated by arrow "A". In other words, contrary to prior art connectors of this type, there are no partitions, walls or other portions of the housing in or along the path of insertion of the terminals which might interfere with total freedom of assembly of the terminals.

Once the terminals are inserted, clam-shell members **42*a* and 42*b* are moved toward each other in the direction of dotted arrows "B" (FIG. 2) to their closed condition encapsulating the inserted terminals. FIG. 1 shows that each clam-shell member has semi-circular recesses 46 which embrace power cables 18**.

The invention contemplates that complementary interengaging retaining means be provided between terminals 14 and clam-shell members **42*a* and 42*b* for holding the terminals in cavities 32 when the clam-shell members are in their closed condition. More particularly, as seen in FIGS. 2 and 4, each clam-shell member 42*a* and 42*b* is provided with an inner surface or shoulder 48 for engaging one of the shoulders 22 on opposite sides of each terminal 14 when the clam-shell members are in closed condition as shown in FIG. 4. Therefore, the terminals are securely seated within housing 12 by interengagement between shoulders 40 of the terminals with shoulders 38 within cavity 32, and by interengagement between shoulders 22 on the terminals and surfaces or shoulders 48** on the clam-shell members.

The invention also contemplates the provision of complementary interengaging latch means between the clam-shell members for latching the clam-shell members in their closed condition. The latch means are provided at both opposite ends of the clam-shell members as well as spanning the interior of the clam-shell members between the terminals. More particularly, as best seen in FIGS. 1 and 3, clam-shell member **42*b* has a hook-shaped latch arm 52 molded integrally with each opposite end thereof. Clam-shell member 42*a* has a recessed ledge 54 at each opposite end thereof and behind which a hook portion 52*a* of the respective latch arm 52 snaps when the clam-shell members are in closed condition as shown in FIG. 3**.

The complementary interengaging latch means between the clam-shell members also include a plurality of pairs of hook-shaped latch arms 56 molded integrally with and projecting from the inside of clam-shell member **42*a*. The shapes of latch arms 56 are best seen in FIG. 2, but FIG. 1 shows that one pair of each latch arms is disposed between terminal receiving cavities 32 and terminals 14. Clam-shell member 42*b* has a plurality of pairs of latch apertures 58, the shapes of which are best seen in FIGS. 2 and 4. The apertures are located in clam-shell member 42*b* such that hook portions 56*a* of latch arms 56 snap into apertures 58 when the clam-shell members are in closed condition as seen in FIG. 4. Therefore, it can be seen that very reliable complementary interengaging latch means are provided not only at the ends of the clam-shell members but also along the lengths of clam-shell members spanning the interior of the housing when the clam-shell members are in their closed condition. Latch arms 56 project between and separate terminals 14, as seen in FIG. 4**.

In addition, clam-shell member **42*b* is provided with a plurality of partition walls 60 which are best seen in FIGS. 1 and 2, for completely separating the terminals. The partition walls are provided immediately adjacent latch arms 56** between the inserted terminals.

From the foregoing, it can be seen that an extremely simple housing 12, i.e., unitarily molded in a single piece, is provided and which allows for totally unrestricted insertion of terminals 14 into cavities 32, as seen by the completely open area surrounding the terminals in FIG. 2. However, once the clam-shell members are in their closed condition, encapsulating the terminals, the clam-shell members are latchingly interengaged substantially along the entire length of the connector, providing an extremely sturdy and reliable construction. All of the features described above for accommodating the terminals and for securing the terminals within the housing are provided without a single extraneous component except for the one-piece unitarily molded housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising a dielectric housing having a forward mating end and a rear terminating end, the forward mating end having a multiple of terminal receiving cavities, a terminal received in each cavity for connection to complementary terminals of an appropriate mating connected when the mating connector is coupled to the mating end of the housing, the terminals being terminated to a conductor projecting from the rear terminating end of the housing, and the rear end of the housing being provided substantially entirely by a pair of clam-shell members movably mounted on the forward end of the housing for movement between an open condition to allow the terminals freely t be inserted into the cavities and a closed condition securely encapsulating the inserted terminals including complementary interengaging latch means between the clam-shell members for latching the clam-shell members in said closed condition said latch means separating the terminals and spanning the interior of the housing when the clam-shell members are in said closed condition and including flexible latch arms projecting from the inside of one clam-shell member and apertures in the surfaces of said second clam-shell member through which said latch arms pass and lock.

2. The electrical connector of claim 1 wherein said complementary interengaging latch means include latch means between the clam-shell members at each opposite end of the housing.

3. The electrical connector of claim 1 including complementary interengaging retaining means between the terminals and at least one of the clam-shell members for holding the terminals in the cavities when the clam-shell members are in said closed condition.

4. The electrical connector of claim 3 wherein said complementary interengaging retaining means are provided between the terminals and both clam-shell members.

5. The electrical connector of claim 4 wherein said complementary interengaging retaining means include shoulders on opposite sides of the terminals engageable with a shoulder on each of the clam-shell members.

6. The electrical connector of claim 1 including hinge means movably mounted the clam-shell members to the forward mating end of the housing.

7. The electrical connector of claim 6 wherein said housing comprises a unitarily molded component and said hinge means comprise unitary living hinge portions thereof.

8. An electrical connector, comprising a dielectric housing having a forward mating end and a rear terminating end, the forward mating end having a multiple of terminal receiving cavities, a terminal received in each cavity for connection to complementary terminals of an appropriate mating connector when the mating connector is coupled to the mating end of the housing, each terminal being terminated to a conductor projecting from the rear terminating end of the housing, the rear end of the housing being provided by a pair of clam-shell members movably mounted on the forward end of the housing for movement between an open condition to allow the terminals easily to be inserted into the cavities and a closed condition securely encapsulating the inserted terminals complementary interengaging retaining means between the terminals and at least one of the clam-shell members for holding the terminals in the cavities when the clam-shell members are in said closed condition, and complementary interengaging latch means between the clam-shell members for latching the clam-shell members in said closed condition said latch means separating the terminals and spanning the interior of the housing when the clam-shell members are in said closed condition and including flexible latch arms projecting from the inside of one clam-shell member and apertures in the surface of said second clam shell member through which sad latch arms pass and lock.

9. The electrical connector of claim 8 wherein said complementary interengaging retaining means are provided between the terminals and both clam-shell members.

10. The electrical connector of claim 9 wherein said complementary interengaging retaining means include shoulders on opposite sides of the terminals engageable with a shoulder on each of the clam-shell members.

11. The electrical connector of claim 8 including hinge means movably mounting the clam-shell members to the forward mating end of the housing.

12. The electrical connector of claim 11 wherein said housing comprises a unitarily molded component and said hinge means comprise unitary living hinge portions thereof.

13. An electrical connector, comprising a unitarily molded dielectric housing having a forward mating end and a rear terminating end, the forward mating end having multiple terminal receiving cavities, a terminal received in each cavity for connection to a complementary terminal of an appropriate mating connector when the mating connector is coupled to the mating end of the housing, the rear end of the housing being provided by a pair of clam-shell members movably mounted on the forward end of the housing for movement between an open condition to allow the terminals easily to be inserted into the cavities and a closed condition securely encapsulating the inserted terminals, and said clam-shell members being movably mounted on the forward end of the housing by unitarily molded hinge portions thereof including complementary interengaging latch means between the clam-shell members for latching the clam-shell members in said closed condition said latch means separating the terminals and spanning the interior of the housing when the clam-shell members are in said closed condition and including flexible latch arms projecting from the inside of one clam-shell member and apertures in the surfaces of said second clam-shell member through which said latch arms pass and lock.

14. An electrical connector, comprising a unitarily molded dielectric housing having a forward mating end and a rear terminating end, the forward mating end having multiple terminal receiving cavities, a terminal received in each cavity for connection to complementary terminals of an appropriate mating connector when the mating connector is coupled to the mating end of the housing, the rear end of the housing being provided by a pair of clam-shell members movably mounted on the forward end of the housing for movement between an open condition to allow the terminal easily to be inserted into the cavity and a closed condition securely encapsulating the inserted terminals, said clam-shell members being movably mounted on the forward end of the housing by unitarily molded hinge portions thereof, and including complementary interengaging retaining means between the terminals and an integrally molded portion of at least one of the clam-shell members for holding the terminals in the cavities when the clam-shell members are in said closed condition and further including complementary interengaging latch means between the clam-shell members for latching the clam-shell members in said closed condition said latch means separating the terminals and spanning the interior of the housing when the clam-shell members are in said closed condition and including flexible latch arms projecting from the inside of one clam-shell member and apertures in the surface of said second clam-shell member through which said latch arms pass and lock.

* * * * *